United States Patent [19]

Pack et al.

[11] Patent Number: 4,920,665

[45] **Date of Patent: * May 1, 1990**

[54] PIVOTING SKI BOOT

[76] Inventors: Roger N. Pack, Box 841, Edwards, Colo. 81632; Eddress Ahmad, Box 1725, Avon, Colo. 81620

[ * ] Notice: The portion of the term of this patent subsequent to Jul. 7, 2004 has been disclaimed.

[21] Appl. No.: 37,531

[22] Filed: Apr. 13, 1987

[51] Int. Cl.[5] ..... A43B 5/04; A43C 9/00

[52] U.S. Cl. ..... 36/117; 36/114; 36/120; 280/613

[58] Field of Search ..... 36/117-121, 36/72 R, 77 R, 114; 280/613, 614, 615

[56] References Cited

U.S. PATENT DOCUMENTS

| | | | |
|---|---|---|---|
| 4,640,026 | 2/1987 | Kirsch et al. | 36/117 |
| 4,677,769 | 7/1987 | Ahmad et al. | 36/117 |

FOREIGN PATENT DOCUMENTS

| | | | |
|---|---|---|---|
| 1041294 | 10/1978 | Canada | 36/117 |
| 0167765 | 1/1986 | European Pat. Off. | 36/117 |
| 568742 | 1/1933 | Fed. Rep. of Germany | 36/117 |
| 2001297 | 10/1970 | Fed. Rep. of Germany | 36/117 |
| 2446066 | 4/1976 | Fed. Rep. of Germany | 36/120 |
| 2925554 | 1/1981 | Fed. Rep. of Germany | 36/117 |
| 3336063 | 4/1984 | Fed. Rep. of Germany | 36/117 |

*Primary Examiner*—James K. Chi

*Attorney, Agent, or Firm*—Timothy J. Martin

[57] ABSTRACT

A ski boot minimizes torsional rotation of the foot while permitting bending movement about the ball of the foot. The ski boot includes a toe portion connected to a heel portion by a hinge structure that prohibits torsional movement therebetween. A heel bracket is connected to and pivots with respect to the toe portion independently of the heel portion. The toe portion has a forward tip that may engage a front ski binding, and the heel bracket has a heel member that may engage a rear ski binding. The heel portion may be releasably fastened to the heel bracket for alpine skiing and walking or released for nordic skiing. Hyperextension and hyperflexion limit stops are provided. Extension linkage may be implemented to space the toe and heel portions.

43 Claims, 7 Drawing Sheets

PIVOTING SKI BOOT

BACKGROUND OF THE INVENTION

The present invention relates to a ski hoot which has a heel portion that pivots with respect to a toe portion while preventing relative torsional rotation. As such, the present invention is an improvement of our copending application, Ser. No. 835,038, now U.S. Pat. No. 4,677,769.

The technology developed in the skiing industry in recent times has been quite fast paced, with improvements being made to skis, bindings and the boots. One area of interest has been the interrelationship between alpine, or "downhill", skiing and a type of nordic skiing generally referred to as "telemarking". The present invention addresses needs in both of these skiing styles.

In the alpine skiing style, a rigid ski boot is locked into front and rear bindings on a relatively wide ski that is provided with cutting edges for permitting fast turns on steep downgrades. A typical alpine ski boot has a completely rigid sole and a completely rigid upper shell that extends over the foot, around the ankle and over a portion of the lower leg. Such ski boots generally do not flex so that the entire lower leg and foot of the human body is maintained in a relative unalterable configuration. Some ski boots, such as the boot shown in U.S. Pat. No. 461,103 issued 24 July 1984 to Annovi, provide a pivot between the foot shell and the ankle shell to allow limited relative movement. These hoots often utilize resilient stiffening members so that resilient force may be applied by the skier to the toe portion of the foot by bending the knees forward against the resilient member.

In the telemark skiing style, it is important that a wide range of flexibility be maintained between the rear of the foot and the toe of the foot since telemarking has similarities to walking. Typical telemark boots or shoes comprise a leather article of footwear having a forward toe hinge that mounts in a front binding of a relatively narrow ski. The rear of the boot is not secured to the ski so that the user may hend the boot along an area adjacent the ball of the foot. Indeed, for competent telemarking, it is necessary that the pivotal relationship between the toe and the heel of the foot exceed the typical range of flexing movement that takes place during walking.

One problem with telemark boots, however, has been their inability to resist torsional rotation about a longitudinal axis and their inability to resist lateral motion of the heel. This problem was recognized in U.S. Pat. No. 4,505,056 issued 19 Mar. 1985 to Beneteau. The Beneteau patent addresses the problem by providing a cross-country ski boot having a plurality of weakening ribs that extend adjacent the ball of the foot across the sides and top thereof. To allow the boot to pivot, Beneteau encases his boot in a relatively stiff shell having a front toe portion and a rear heel portion separated and interconnected by a flat, flexing region of the rigid shell. The shell is then pivotally attached to a ski binding so as to prevent torsional rotation and lateral movement of the heel.

In addition to the prior art devices noted above, many other inventors have recognized the lack of comfort generated by an inflexible alpine boot when the skier removes the skis and attempts to walk from one location to another. To this end, there have been numerous developments of ski boots which flex slightly to allow greater ease in walking. One such prior art device is shown in U.S. Pat. No. 3,972,134 to Kastinger wherein a boot having a stiff sole and a rigid upper shell includes regions of reduced strength at a fore part of the foot to allow bending of the foot forwardly of the ankle, and pleats are provided at a forward part of the ankle to facilitate walking. U.S. Pat. No. 3,535,800, issued 27 Oct. 1970 to Stohr, shows a ski boot that flexes about a pivot on the ankle with this flexing accomplished by baffles extending forwardly and rearwardly of the boot at the ankle region.

U.S. Pat. No. 3,953,930, issued 4 May 1976 to Ramer, also discloses a ski boot designed for greater ease in walking. In the Ramer structure, a flexible sole is provided to support a rigid shell defining a heel portion and a forward foot portion being telescopically inserted into the rigid shell defining a toe portion for the boot. As the skier walks in this boot, the toe portion and the heel/-foot portion telescope with respect to one another. Limit stop means for preventing hyperextension of the floating toe Portion is Provided to limit relative movement between the toe portion and the heel portion.

Many of these problems were addressed in our earlier application, as noted above, wherein we disclosed an article of footwear having a pivotal toe structure. In this device, independent toe and heel portions are relatively pivotally rotatable with respect to one another over a fairly large angular range. The toe and heel portions are hinged together to form the foot enclosure and pivot to allow relative ease in walking and to permit rotational movement in telemarking. At the same time, the hinging is accomplished in a manner that restricts relative torsional rotation so that the ski boot may be used for alpine skiing.

The combination of these two skiing styles has traditionally been performed by only the most capable and dedicated of skiers because of the difficulty in making parallel turns in conventional telemarking boots. However, if a boot as contemplated above were available, such style combinations would most undoubtedly become more popular, perhaps extremely so, since the enhanced ability to make parallel turns in such a boot would put he sport within the reach oil the average skier. Moreover, it is expected that skiers would readily take to the sport because it would provide them with another way of skiing and thereby add more variety to the already popular sport.

Despite the improvements of these prior art patents over earlier ski boots, there still remains a need for a ski boot that may be employed for both alpine and telemark style skiing. There is a particular need for a ski boot which may remain locked in both the front and rear bindings of a ski boot which is structured so that the heel portion pivots or rotates about the ball of the foot while at the same time remaining rigid against torsional rotation and lateral movement of the heel portion. Such a boot's resistance to rotation and lateral movement would make it much easier for the telemarking skier to make and control traditional "alpine style" parallel turns.

SUMMARY OF THE INVENTION

It is therefore an object of the present invention to provide a novel and useful ski boot having independent toe and heel portions that pivot with respect to one another over a fairly large angular range.

It is a further object of the present invention to provide a ski boot wherein toe and heel portions are pivotally connected to one another about the axis of the ball of the foot so as to allow relative ease in walking even when such boot is constructed of rigid materials.

A still further object of the present invention is to provide a ski boot having a pivot axis between a rigid toe portion and a rigid heel portion which axis is oriented at an angle with respect to the boot's longitude that corresponds to the axis of the ball of the foot.

It is still a further object of the present invention to provide a ski boot having a heel bracket so that such ski boot may be used for both telemark and alpine skiing while, at the same time, being configured to be mountable into standard alpine bindings.

Another object of the present invention is to provide a ski boot which is mountable in standard bindings on an alpine-style ski but which permits the skier to implement both telemark and alpine style skiing.

It is yet another object of the present invention to provide a ski boot which prevents the build up or compaction of snow between the underside of the boot and the ski which is caused by the downward motion of the boot's heel against the ski in Nordic style skiing such as telemarking or cross-country skiing.

A further object of the present invention is the provision of a ski boot with pivotal parts to facilitate walking.

According to the present invention, then, a ski boot with pivotal heel assembly as provided that is broadly comprised of a toe portion, a rear heel portion and a heel bracket which are pivotally secured to one another for relative rotation. More particularly, a toe portion is provided which has a toe sole and a relatively rigid upper toe shell which are secured to one another and configured to extend around and enclose a forward part of the foot. The toe portion extends from the tip of the toe rearwardly to a location proximate the ball of the foot so that the upper toe shell has a rear edge which extends over the ball of the foot. The forward tip of the toe portion is constructed to be received by a standard front binding mounted on a ski. The rear heel portion has a rear sole and a relatively rigid upper rear shell with the upper rear shell having an access opening adapted to permit insertion and removal of the skier's boot. This upper shell extends around the ankle in the back part of the foot forwardly to a location proximate the ball of the foot so that it has a forward edge which extends over the ball region. The rear sole underlies the foot and extends from the ball of the foot rearwardly to a sole heel located beneath the skier's heel. A hinge structure, preferably in the form of a trunnion pin hinge, interconnects the toe portion and the rear heel portion for relative rotational motion about a fixed rotational axis that is generally in a plane substantially parallel to the plane of the toe sole. This rotational motion may extend between a flat position wherein the respective planes of the rear and the toe soles are substantially parallel to one another to a flex position wherein the planes of the soles are a a large acute angle with respect to one another. The trunnion pin hinge also mounts a heel bracket for relative rotation with the toe and heel portions. The heel bracket includes a heel member located adjacent the sole heel when the boot is in the flat position. The heel bracket pivots independently of the heel portion with respect to the toe portion, and the heel member is sized and configured to be received in a standard rear binding on a ski. If desired an extension linkage structure may be used to hinge the toe and heel portions together in a further spaced-apart relation.

Preferably, the structure of the ski boot includes a releaseable locking structure which may be operated to selectively secure the heel bracket against relative rotation with respect to the heel portion of the ski boot. Accordingly, when the ski boot is secured within ski bindings, the skier may ski in an alpine style with the ski bracket being locked against rotation with respect to the heel portion. Upon release of the heel bracket, however, the skier may choose to ski according to a telemark style which broadly includes the style of skiing known as cross-country. In order to prohibit hyperextension of the ski boot, which could result either in damage to the skier's foot or result in the release of the toe portion from the binding, a hyperextension limit stop is provided. Likewise, in order to prevent hyperflexion of the heel and toe portions beyond a maximum selected angle, a hyperflexion limit stop may be used as well.

Furthermore, since the providing of a relative rotation between the toe portion and the heel portion of the ski boot creates open regions which would otherwise permit the ingress of snow and other unwanted materials, these regions may be masked by additional boot structure. At an upper portion of the ski boot between the toe portion and the heel portion, a toe baffle may be mounted which toe baffle extends completely across the junction area between the upper region of the toe and heel portions and may be attached to each of these portions. Preferably, this toe baffle is provided with transverse pleats to allow flexibility while screening unwanted materials out of the ski boot. Between the toe sole and the heel sole, a guard panel may also be provided. This guard panel may be mounted in facing cavities in each of the soles, and may extend substantially across the transverse dimension of the respective soles. This guard panel may either be formed of a resilient material which stretches as the toe portion and heel portions rotate with respect to one another or may be a sliding panel or other structure to accomplish the protection of the interior of the ski boot from the ingress of snow and the like.

In the preferred form of the present invention, the heel bracket is in the form of a flat heel plate having an upstanding rim that engages the rea binding with the flat plate being connected to the toe portion by means of a pair of bracket arms that extend upwardly and forwardly along the heel portion of the boot, on either side thereof. These bracket arms terminate in forward ends that are received on the common rotational axis of the toe and heel portions by means of a trunnion pin structure. Furthermore, in order to dislodge any snow which may become compacted between the sole heel and the heel plate, one of the sole heel and heel plate may be provided with a wedge structure, preferably in the form of a star wedge, which attacks the compacted snow thereby dislodging the snow laterally and forwardly of the heel plate. Other forms of the heel bracket are within the scope of the present invention. One such alternate embodiment would include a heel plate that is formed as a grate to allow passage of snow therethrough. Further, the heel member could be a U-shaped strap structure that extends from either side of the sole heel around the rear of the heel portion so that the sole heel is completely received within the strap structure when the boot is in a flat position.

These and other objects of the present invention will become more readily appreciated and understood from a consideration of the following detailed description of the preferred embodiment when taken together with the accompanying drawings, in which:

DETAILED DESCRIPTION OF THE PREFERRED EMBODIMENT

The present invention is directed to a ski boot which has relative rotatably toe and heel portions which are hingedly secured to one another and include a heel bracket so that the ski boot may be mounted in conventional front and rear bindings on a ski. This invention is further directed to a ski boot which, when so mounted, is usable for both alpine style skiing and for nordic or telemark style skiing. In alpine skiing, the heel portion of the present invention may be locked against relative rotation with the toe portion. In the telemark mode, the ski boot may be rigidly secured to the ski in such a manner that the toe and heel portion pivot with respect to one another but are constrained against relative torsional rotation. When released from the ski, the ski boot according to the present invention, provides ease in walking.

Figure 1:
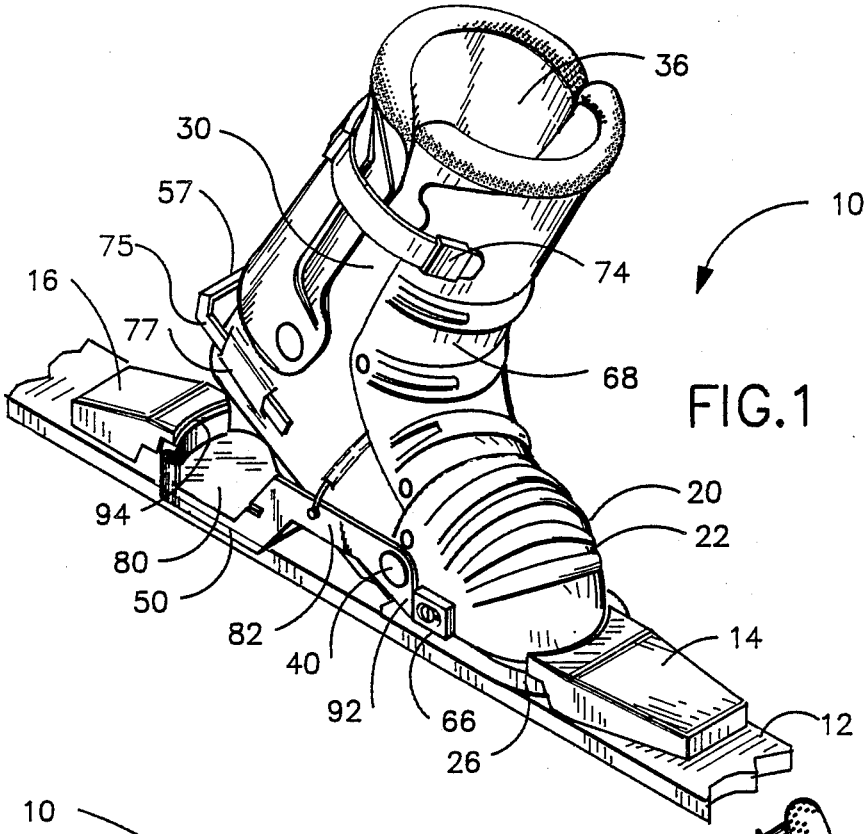
FIG. 1 is a perspective view of a pivotal ski boot according to the preferred embodiment of the present invention shown mounted to a ski for nordic style skiing.
Figure 6:
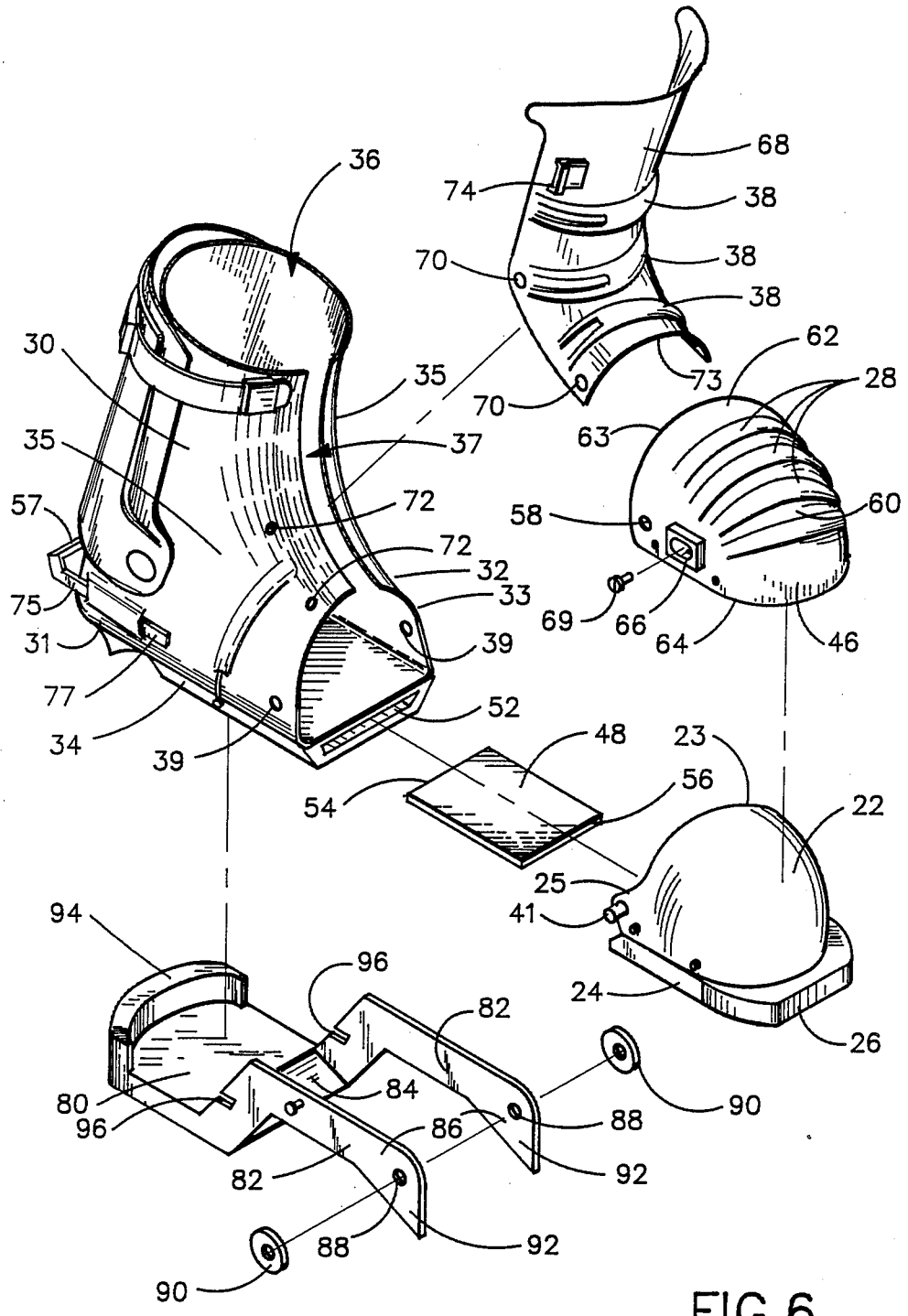
FIG. 6 is an exploded view in perspective of the ski boot shown in FIGS. 1–5.

As is shown in FIG. 1, ski boot 10 is mounted on ski 12 by front binding 14 and rear binding 16. With reference to FIGS. 1 and 6, ski boot 10 includes a toe portion 20, a heel portion 30 and a heel bracket 50. Toe portion 20 includes a relatively rigid upper toe shell 22 and a lower toe sole 24 that terminates in a forward tip 26 adapted to be received and engaged by front binding 14. A toe baffle 46 forms part of toe portion 20 and has pleats 28 to allow flexing of the upper portion of toe baffle 46. Heel portion 30 includes a relatively rigid upper rear shell 32 and a rear sole 34. Rear shell 32 has an access opening 36 to permit insertion of the skier's foot into ski boot 10. Rear shell 32 has an upwardly located longitudinal split 37 which separates the upper portion of rear shell 32 into a pair of side panels 35. An ankle baffle 68 is attached to rear shell 32 across split 37 and has additional pleats 38 in order to allow flexing at the ankle area of the foot. Pleats 28 and pleats 38 run transversely across the upper surface of ski boot 10.

From the foregoing, it should be appreciated that, in the preferred embodiment, toe portion 20 and heel portion 30 are formed as independent structural units. These units are hinged together In any suitable manner, such as trunnion pin hinges. For example, trunnion hinge 40 is shown in FIGS. 1–6 and 8. These hinges serve as a pivotal mount not only for the relative rotational motion of toe portion 20 and heel portion 30, but also for the pivotal attachment of heel bracket 50, as is described more thoroughly below. Thus, an open wedge-shaped region 42 is present between toe portion 20 and heel portion 30, as is shown in phantom in FIG. 4. Open region 42 is thus located between rear edge 23 of toe shell 22 and forward edge 33 of rear shell 32. At a lower position, between toe sole 24 and rear sole 34, an open region 44 is present, again as shown in phantom in FIG. 4. These regions are covered against the unwanted ingress of snow and other materials. For example, open region 42 is covered by toe baffle 46 while open region 44 is substantially closed by means of flexing panel 48.

Figure 3:
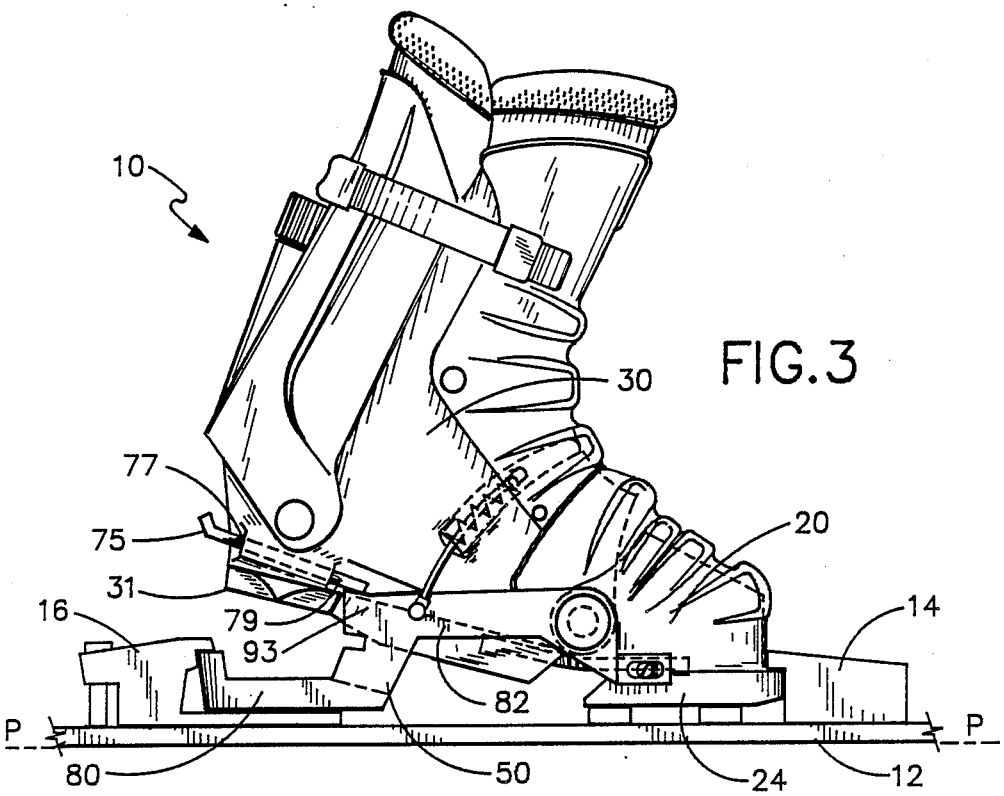
FIG. 3 is a side view in elevation of the ski boot shown in a position for uphill cross-country skiing.
Figure 8:
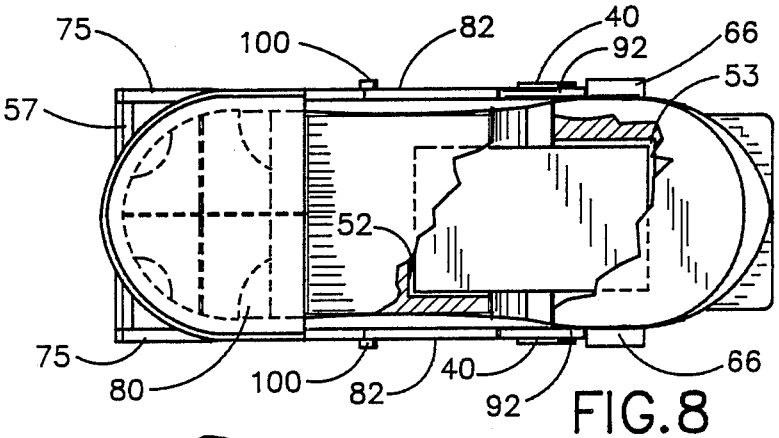
FIG. 8 is a bottom plan view of the ski boot shown in FIGS. 1–5.

The construction of ski boot 10 can now be seen with greater particularity in reference to FIGS. 6 and 8. Here, toe shell 22 is shown, including toe sole 24 and forward tip 26 as an integral extension of sole 24. Toe shell 22 supports a pair of rearwardly extending wings, such as wing 25 from which laterally project a pair of trunnion pins, such as trunnion pin 41. Rear shell 32 includes rear sole 34 from which upwardly and inwardly extend a pair of side panels 35 which are split at 37 to allow relative lateral movement of side panels 35. Each of side panels 35 is provided with a bore 39, which receive a respective trunnion pins 41 in order to secure toe shell 22 and rear shell 32 together. Flexing panel 48 is received in facing cavities formed in toe sole 24 and in heel sole 34. For example, cavity 52 receives a rear edge 54 of panel 48, and forward edge 56 of panel 48 is received in a similar cavity 53 formed in toe sole 24. Panel 48 is formed of a stretchable material that is affixed at its opposite end portions, lin any convenient manner, to the respective toe and heel soles. Alternately, cavities 52 and 53 can be sized along with panel 48 so that panel 48 simply flexes and freely slides within cavities 52 and 53 without becoming disengaged. Toe baffle 46 is then mounted on the adjoined toe and rear shells 22 and 32 such that the trunnion pins 41 project through opposite lateral holes, such as hole 58. Toe baffle 46 has a forward portion 60 that is sized to nestably receive toe shell 22, and a rear portion 62 that receives a forward portion of side panels 35 of rear shell 32. Thus, rear portion 62 of toe baffle 46 overlaps open region 42 as shown in FIG. 3. Further, toe baffle 46 has a lower edge 64 which, when mounted on toe shell 22, abuts an upper surface of toe sole 24. Toe baffle 46 carries at least one adjusting block 66, described more thoroughly below, and it should be appreciated that, if desired, a pair of adjusting blocks 66 may be provided with there being an adjusting block on each side of toe baffle 46. Toe baffle 46 is provided with transverse pleats 28 of toe portion 20, as noted above.

Ankle baffle 68 is received along the upper surface of heel shell 32 so as to cover open region 37 between side panels 35. Ankle baffle 68 carries transverse pleats 38 of heel portion 30 and is mounted on heel shell 32 such as by screws threadably received through holes 70 and holes 72 in rear shell 32. Ankle baffle 68 has a forward edge 73 which is configured to abut rear edge 63 of toe baffle 46 at a location rearwardly of forward edge 33 of toe shell 32. A latch 74 is provided at an upper portion of ankle baffle 68. Heel portion 30 carries a pair of locking bars, such as locking bar 75, on each side thereof. The purpose of locking bars 75 are described below. Each bar 75 is received in guides, such as guide 77, formed in the sidewall of rear shell 32.

Heel bracket 50 is also pivotally secured to boot 10 by trunnion pin hinges 40, and, while other methods of pivotally attaching heel bracket 50 are within the scope of this invention, the mounting of heel bracket 50 by means of trunnion pin hinges 40 provides a common transverse pivot axis for relative pivotal motion between toe portion 20, heel portion 30 and heel bracket 50. As is shown in FIG. 6, heel bracket 50 includes a heel receiving member such as heel plate 80 that may be pivoted to be adjacent the sole heel 31 of heel portion 30. A pair of bracket arms 82 extend upwardly and forwardly of forward edge 84 of heel plate 80 to terminate at free ends 86 that have holes 88 formed therein. Holes 88 are sized to receive trunnion pins 41 and may each be provided with a bearing 90 to facilitate relative pivotal motion. Free ends 86 include a downwardly depending shoulder 92 which is configured to abut adjusting block 66, as more thoroughly described below. Reasonably facing slots 96 are formed in the intermediate portions oil heel bracket 50 located between heel plate 80 and each bracket arm 82. A rearward edge of heel plate 80 is provided with an upstanding rim 94 which is structured to engage rear binding 16 of ski 12. Accordingly, heel bracket 50 is configured in the region of heel plate 80 to receive sole heel 31 in a nested manner so that sole heel 31 is adjacent heel plate 80 between rim 94 and forward edge 84 of heel plate 80.

Figure 2:
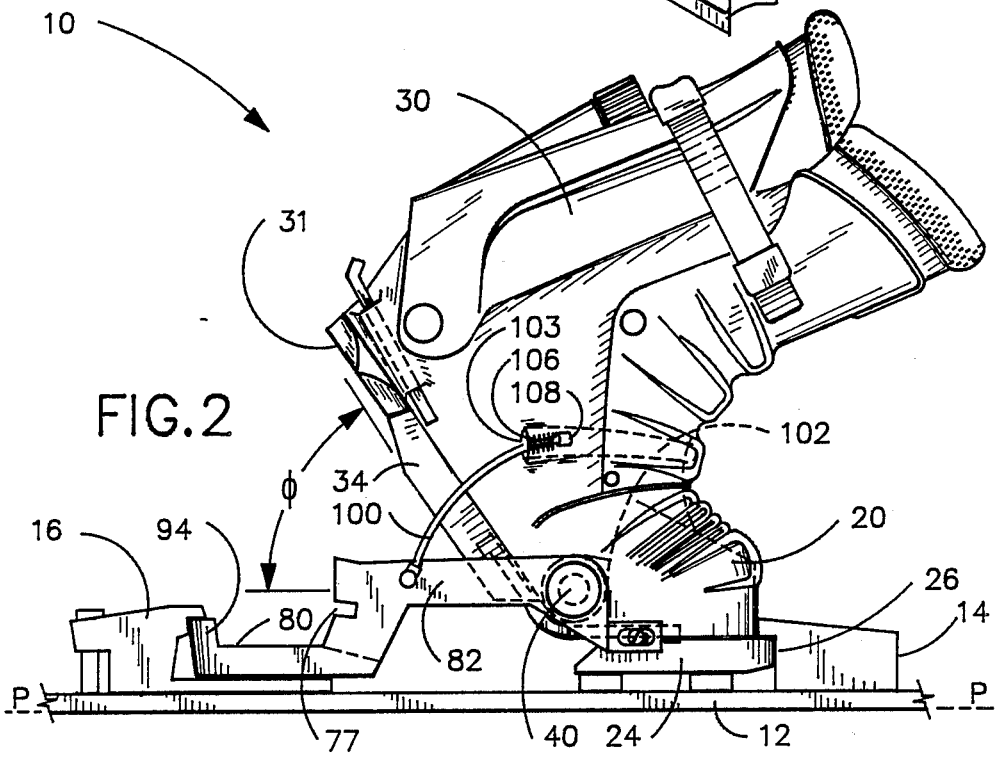
FIG. 2 is a side view in elevation of the ski boot shown in FIG. 1 shown in a full telemark position.

Turning to FIGS. 1 through 5, it should be appreciated that the above-described structure permits versatility in using ski boot 10 in a variety of skiing and walking modes. For example, as is shown in FIG. 1, ski boot 10 is in an intermediate position between a flat position shown in FIG. 4 and a fully flexed position shown in FIG. 2. Thus, the intermediate position shown in FIG. 1 would occur during cross-country skiing or nordic skiing. In this configuration, rim 94 is secured in rear binding 16 while forward tip 26 is secured in front binding 14. Locking bars 75 are released from slots 96. In this configuration, toe portion 20 and heel bracket 50 are relatively fixed with respect to one another while heel portion 30 may pivot between the fully flexed position and the flat position. As the skier bends his leg and knees forwardly from the position shown in FIG. 1, ski boot 10 will move into the fully flexed position shown in FIG. 2. In this position, rear sole 34 is oriented at an angle 0 of approximately 55° to 65° with respect to the plane P of ski 12 and, correspondingly, the plane of toe sole 24. Since it is desireable to prohibit hyperflexion of heel portion with respect to toe portion 20, cables 100 are received in respective channel structures such as channel structure 102 on rear shell 32. Two such channels 102 are provided on each of side panels 35 and a pair of cables 100 employed. Each cable 100 is secured, at a first end, to a respective bracket arm 82 of heel bracket 50. The opposite end 106 of each cable 100 is provided with an enlarged head 108 that is sized so that it may not be removed from mouth 103 of its respective channel structure 102. Cable 100 thus performs two functions for ski boot 10. As is shown in FIG. 2, the length of cable 100 defines an upper pivot or limit stop to limit the maximum angle of relative pivoting of heel portion 30 with respect to toe portion 20 in a direction from the flat configuration shown in FIG. 4 to the fully flexed position shown in FIG. 2. Furthermore, since it is desireable that ski bindings 14 and 16 still release in the fully flexed position, cables 100 act to transfer release force onto heel bracket 50 so that this force is exerted in an angularly upwardly direction on rim 94 thereby placing a release force on rear binding 16. In the event that too much force is applied which would tend to pivot ski boot 10 into a hyperflexed position, heel bracket 50 will be pulled upwardly against binding 16 so that rim 94 will become released when a threshold force is reached.

Figure 4:
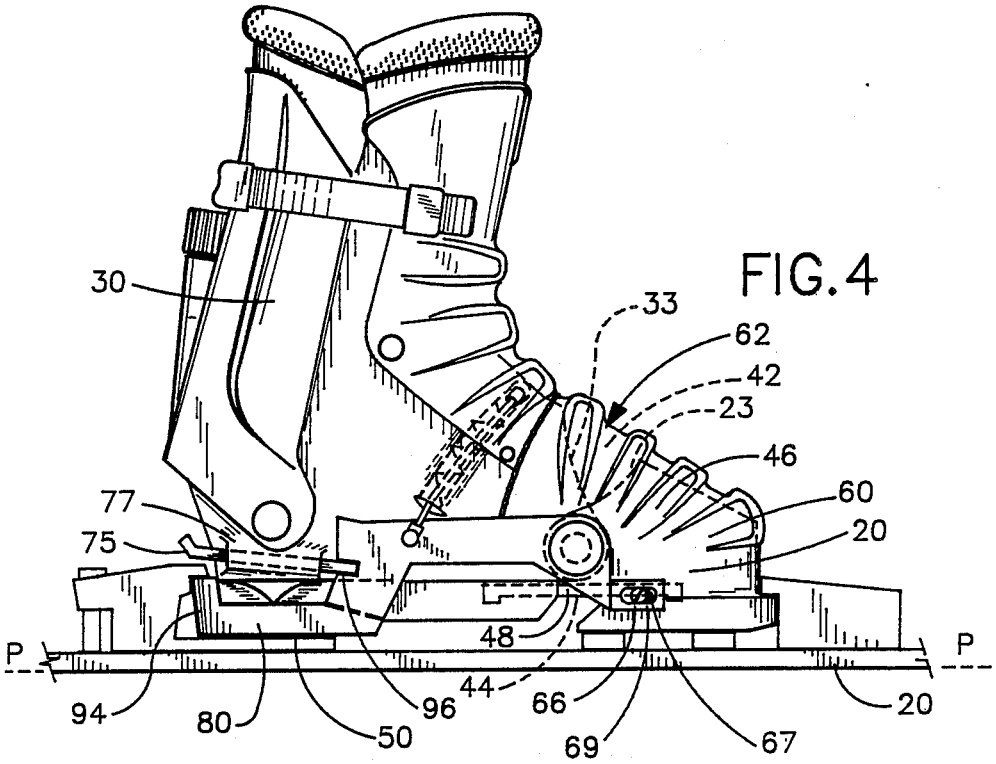
FIG. 4 is a side view in elevation of the ski boot shown in FIG. 1 in the locked position for alpine style skiing.

Should the skier desire to engage in pure alpine skiing, ski boot 10 is pivoted downwardly from the flexed position shown in FIG. 2 to the flat position shown in FIG. 4. In this position, locking bars 75 are slid forwardly in respective channel guides 77 so that locking bars 75 engage slots 96 on heel bracket 50. To this end, locking bars 75 are preferably connected by a crosspiece 57 to form a single unitary U-shaped locking bolt. In this configuration, toe portion 20, heel portion 30 and bracket 50 are locked against relative rotation so that the skier may enjoy alpine skiing. In the alpine mode, it is necessary to prevent hyperextension of the boot. That is, it is required that the toe and heel portions not be permitted to pivot past the flat position from the flexed position. Thus, a hyperextension limit stop is provided on ski boot 10. Specifically, adjusting blocks 66 are mounted on opposite sides of toe baffle 46 so that they are located on toe portion 20 of ski boot 10. Each adjusting block 66 includes a slot 67 through which a tightening screw 69 extends. Each of shoulders 92 are configured to abut adjusting block 48 when ski boot 10 is in the flat position. Accordingly, shoulders 92 and adjusting blocks 66 define a hyperextension limit stop means to keep ski boot 10 from pivoting from the flexed position past the flat position. It is desireable that such a limit stop be provided; otherwise, not only could hyperextension occur, but also hyperextension rotation of toe portion 20 could conceivably allow forward tip 26 to become inadvertently disengaged from binding 14. The adjustment of block 66 allows selective adjustment of this limit stop means.

Should the skier desire to engage in cross-country or nordic skiing on an uphill grade, the present invention offers a further configuration for uphill skiing, as is shown in FIG. 3. Here, after flexing ski boot 10 to the intermediate position shown in FIG. 1, locking bars 75 are slid forwardly in guides 77 so that the forward ends 79 of locking bars 75 engage upper edge 93 of each shoulder 92. This abutment prohibits ski boot 10 from pivoting into the fully flat position and has been found to be more comfortable since it places the skier in a more vertical position when skiing on an uphill grade.

Figure 5:
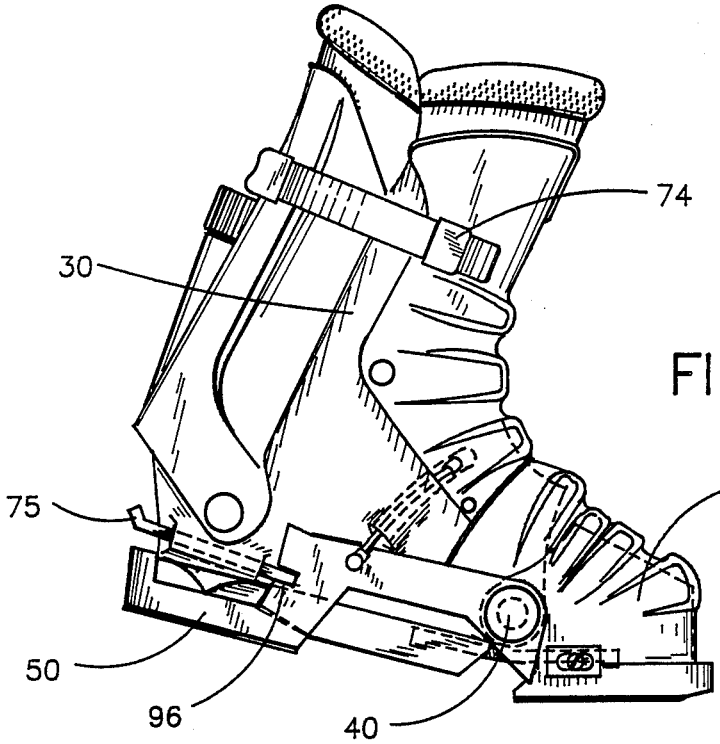
FIG. 5 is a side view in elevation of the ski boot shown in FIG. 1 in the walking mode.

The structure according to the preferred embodiment of the present invention also provides more comfort when ski boot 10 is worn during walking. As is shown in FIG. 5, should the skier decides to walk while wearing ski boot 10, the skier simply pivots ski boot 10 into the flat position and engages locking bars 75 with slots 96. Thus, heel bracket 50 is locked onto heel portion 30 with heel portion 30 and heel bracket 50 secured for common rotation about hinge 40 with respect to toe portion 20. Accordingly, ski boot 10 will easily flex in the toe region about the ball of the foot so that fairly normal walking may be achieved.

Figure 7:
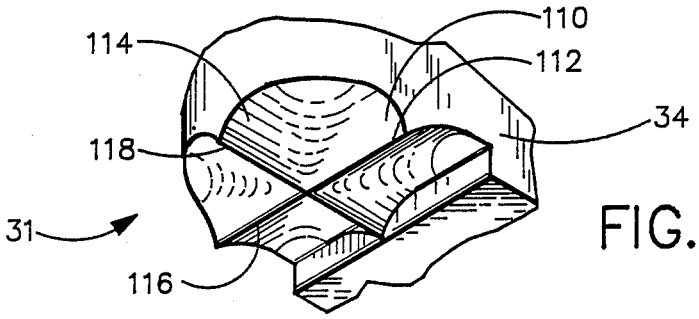
FIG. 7 is a perspective view of the sole heel of the ski boot according to the present invention showing the star wedge for dislodgement of snow.

Since it is contemplated that the present ski boot 10 be used for nordic skiing, there is a tendency for compaction of snow between sole heel 31 and heel plate 80 as ski boot 10 pivots between the flat and flexed position. In order to help dislodge any compacted snow that might build up on heel plate 80, sole heel 31 is provided with a dislodgement means in the form of star-shaped wedge structure 110 which is formed by transverse wedge 112 and a longitudinal wedge 114. This structure is best shown in FIG. 7. Each of these wedges 112 and 114 are wider at their base but taper upwardly to respective edge 116 and 118 When sole heel 31 moves downwardly against any snow that may have built up on heel plate 80, edges 116 and 118 cut into the compacted snow and the diverging sidewalls of star wedge 110 tend to laterally and forwardly discharge any of the compacted snow therefrom.

Figure 9:
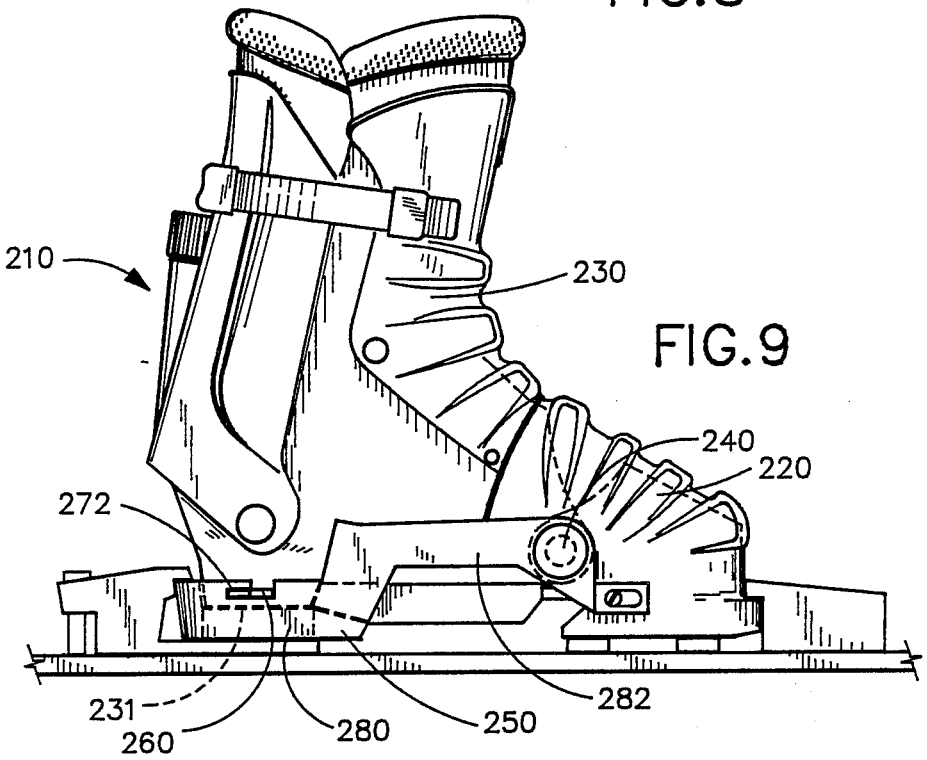
FIG. 9 is a side view in elevation of a first alternate embodiment of the present invention.
Figure 10:
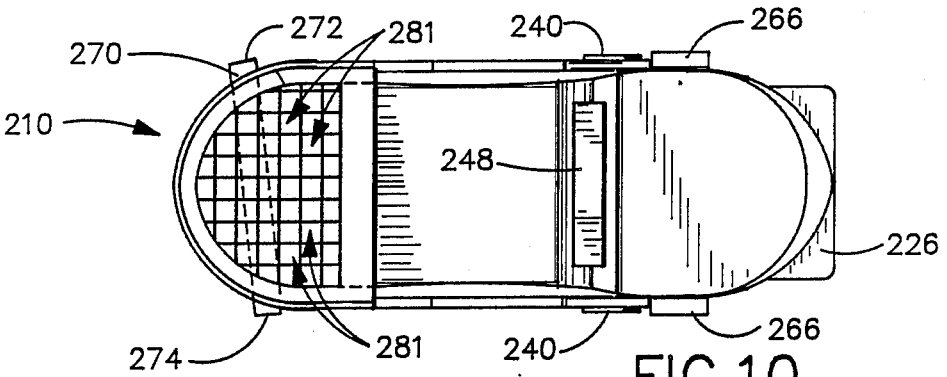
FIG. 10 is a bottom plan view of the ski boot shown in FIG. 9.
Figure 11:
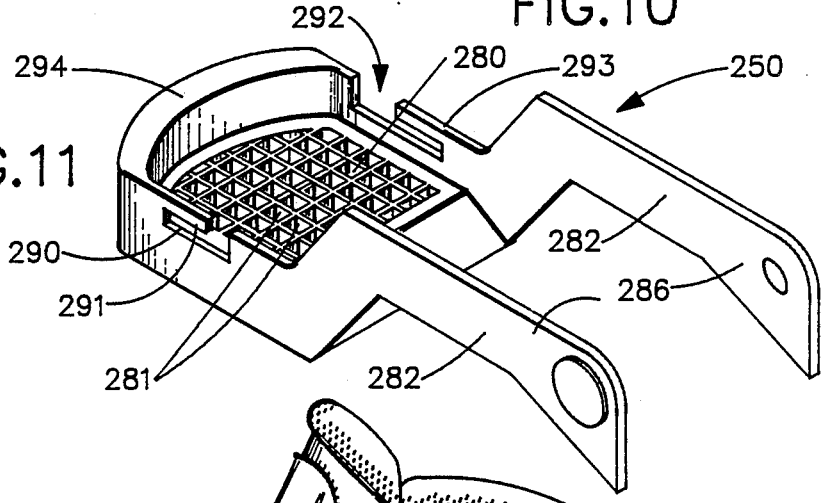
FIG. 11 is a perspective view of the heel bracket assembly of the ski boot shown in FIGS. 9 and 10.

A first alternate embodiment of the present invention is shown in FIGS. 9–11. In this alternate embodiment, modification is made both to the heel bracket and to the latching means for selectively securing the heel bracket to the heel portion of the ski boot for common rotation with the heel portion. As is shown in these Figures, heel bracket 250 is configured similarly to heel bracket 50 of the preferred embodiment. In FIG. 11, however, it can be seen that heel plate 280 is formed as a grate having an array of vertically extending openings 281. A pair of bracket arms 282 extend above and forwardly of heel plate 280 so that they are oriented along each side of heel portion 230 and terminate at a forward end 286 where they are pivotally secured to both heel portion 230 and toe portion 220 oil ski boot 210 by means of a trunnion pin hinge assembly 240. Sole heel 231 may be flat or may be provided with a star wedge, as desired. Bracket 250 has an upstanding rim 294 sized to be engaged by a rear binding of a typical ski binding pair, and toe portion 220 terminates in a forward end 226 configured to be received in a front binding. As is shown in FIG. 10, a flexible guard panel 248 is located at an under portion of ski boot 210 in order to prevent the unwanted ingress of snow and other material into the ski boot.

As is shown in FIGS. 9–11, ski boot 210 includes a different latching structure for selectively locking heel portion 230 to heel bracket 250 for common pivotal motion with respect to heel portion 220. Here, an elongated bar 270 extends transversely through the heel portion 231 of ski boot 210, with transverse bar 270 being pivotally affixed in a transverse passageway 260. Bar 270 has opposite latch ends 272 and 274 each adapted to engage respective L-shaped slots 290 and 292 formed on the side of ski bracket 250 The orientations of L-shaped slots 290 and 292 must be reversed from one another, as is shown in FIG. 11, so as to commonly engage and release the rotating ends oil the bar 270. Thus, slot 290 has a forwardly projecting latch finger 291 while slot 292 has a rearwardly projecting latch finger 293. End 274 opposite end 272 is adapted to be manipulated by the fingers of the skier and, when heel 231 is an abuting relationship with heel plate 280, end 274 may move back and forth in a cut-out region 292. Use and operation of the ski boot 210 is the same with respect as that described with respect to ski boot 10, it being appreciated that the grated heel plate 280 helps prevent the unwanted compaction of snow during the pivotal motion of heel portion 230 with respect to heel bracket 250.

Figure 12:
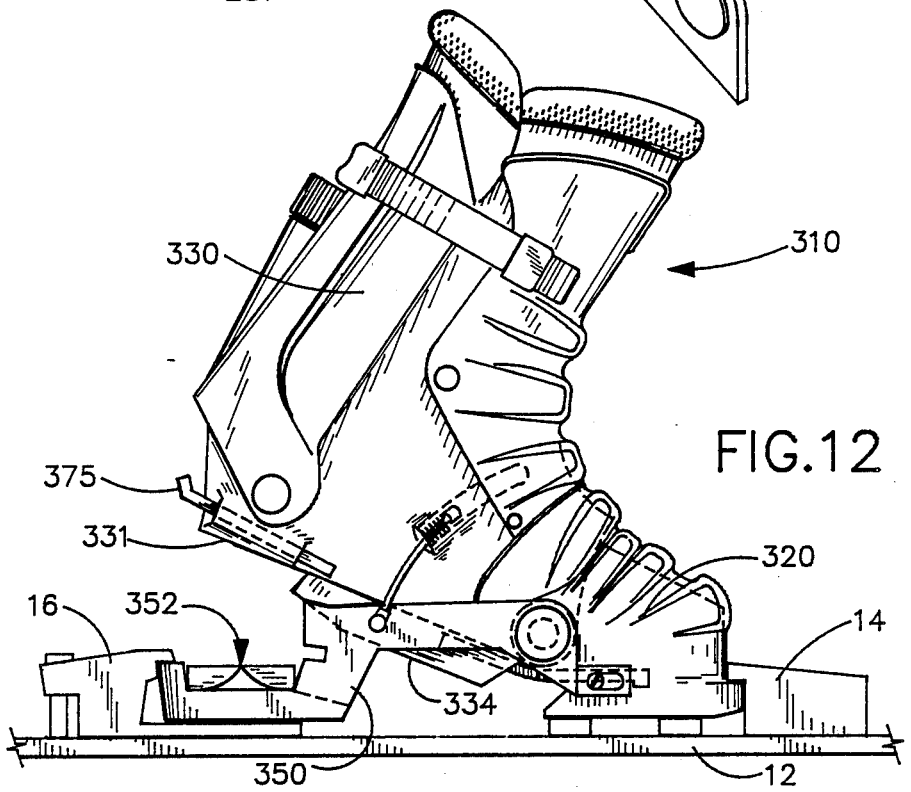
FIG. 12 is a side view in elevation of a second alternate embodiment of the present invention.
Figure 13:
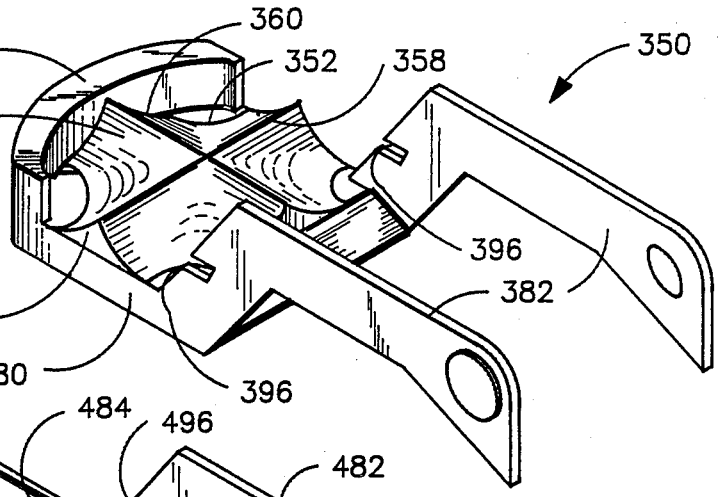
FIG. 13 is a perspective view of the heel bracket used with the ski boot shown in FIG. 11.

A second alternate embodiment of the present invention is shown in FIGS. 12 and 13. Here, heel bracket 350 is modified by providing a star wedge 352 on heel plate 380. A pair of bracket arms 382 extend upwardly and forwardly of heel plate 380, and heel plate 380 terminates in an upstanding rim 394 at a rear portion with rim 394 being sized to engage a rear binding of the ski. Star wedge 352 includes a transverse wedge 354 and a longitudinal wedge 356 that terminate in upwardly positioned edges 358 and 360, respectively. Slots 396 are provided on heel bracket 350 in order to engage locking bars such as locking bar 375 which are configured identically to those with respect to the preferred embodiment of the present invention. Ski boot 310 includes a toe portion 320 and a heel portion 330 which are similar in all respects to the construction of ski boot 10; however, sole heel 331 of ski boot 310 is flat in configuration and is in a spaced, stepped relation to heel sole 334 in order to accommodate the star wedge 352 on heel plate 380.

Figure 14:
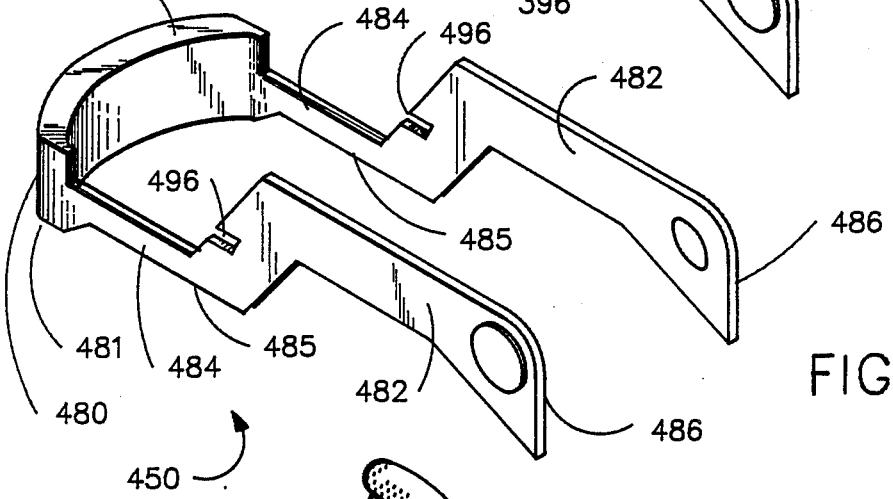
FIG. 14 is a side view in elevation of a third alternate embodiment of the present invention.
Figure 15:
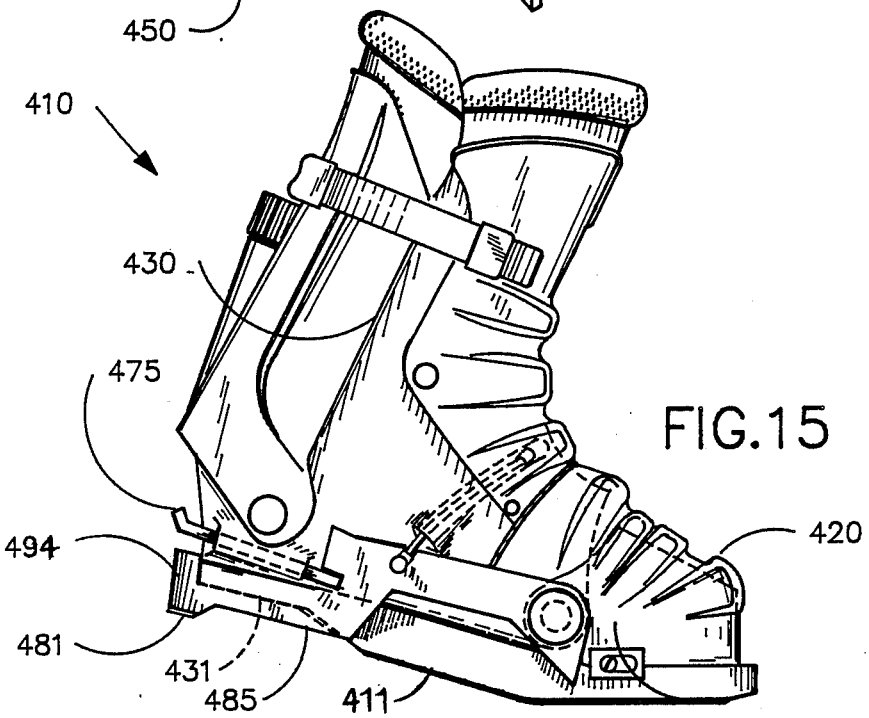
FIG. 15 is a perspective view of the heel bracket used with the ski boot shown in FIG. 14.

A final embodiment of the present invention is shown in FIGS. 14 and 15. Here, modification is made to the heel bracket structure and to the sole of ski boot 410. Specifically, the sole of boot 410 is a flexible unit of integral construction. Thus, the toe, sole and the heel sole formed as a single sole piece 411. Heel bracket 450 includes a heel member 480 which departs from the heel member of the preceeding embodiments (as represented by heel plates 80, 280 and 380). In this third embodiment, heel member 480 is in the form of a U-shaped strap that includes side strap portions 484 and a rear heel portion 494 adapted to engage a rear binding. A pair of bracket arms 482 extend as integral forward extensions of side portions 484 and terminate at ends 486 similar to bracket 50. Slots 496 are provided to receive the ends of the locking bar 475. It should be appreciated that the lower edge 485 of each side portion 484 is in a spaced apart relation above lower surface 481 of heel portion 494. Thus, when bracket 450 is secured to heel portion 430 of boot 410, as is shown in FIG. 15, laterally positioned open regions will be positioned under sole heel 431 of ski boot 210. Thus, snow can be dislodged laterally of sole heel 431 as heel portion 430 pivots with respect to toe portion 420.

Figure 16:
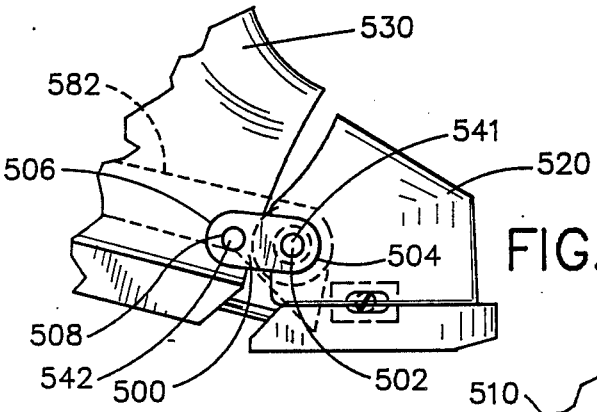
FIG. 16 is a side view in elevation of a front portion of the ski boot according to another modification of the present invention.
Figure 17:
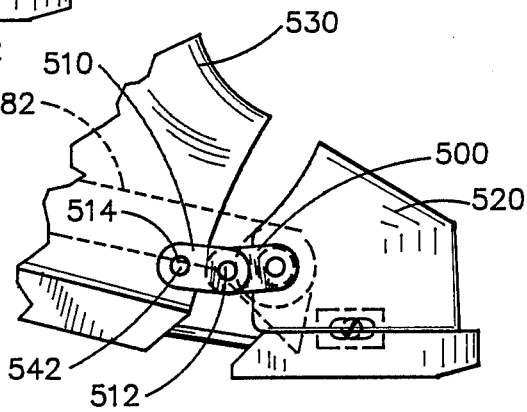
FIG. 17 is a side view in elevation of the front portion of the ski boot shown in FIG. 16 with a further modification thereto.

FIGS. 16 and 17 show further modifications to the preferred embodiment of the present invention shown in FIG. 1. Specifically, FIGS. 16 and 17 include the addition of one or more extension links which position the toe and heel portions further apart in longitudinal spacing. This further distancing in a longitudinal direction between the toe portion and the heel portion helps prevent pinching of the foot across the upper region above the ball of the foot. Specifically, as is shown in FIG. 16, a single extension link 500 has a first hole 502 which receives trunnion pin 541 of trunnion hinge assembly 40. Bracket arm 582, shown in phantom, is connected to trunnion pin 541 in the manner with that described with respect to FIGS. 1–8. Thus, a front portion of link 500, bracket arm 582 and toe portion 520 are hinged by pin 541 for common rotational movement. However, heel portion 530 is not hinged directly onto pin 541. Rather, heel portion 530 is hinged to a second end portion 506 of link 500 by means of a pin 542 which extends through a hole 508 in length 500. FIG. 17 uses a dual extension link where a second extension link 510 is pivoted by pin 512 onto first link 500 with pin 512 extending through the second hole 508 of link 500 and a forward hole in link 510. Pin 542 of heel portion 530 then extends through a second hole 514 at the rear of link 510. Thus, toe portion 520 and heel portion 530 are hinged together, on each side thereof, by means of this chain linkage structure which allows pivoting in a vertical direction but does not allow transverse movement or torsional rotation. It should thus be appreciated that the chain linkage must be sturdy enough to resist torsional rotation while allowing the pivotal movement.

Accordingly, the present invention has been described with some degree of particularity directed to the preferred embodiment of the present invention. It should be appreciated, though, that the present invention is defined by the following claims construed in light of the prior art so that modifications or changes may be made to the preferred embodiment of the present invention without departing from the inventive concepts contained herein.

We claim:

1. A ski boot for receiving a skier's foot and ankle in a manner that minimizes torsional rotation of the foot, while permitting bending movement about the ball of the foot and adapted for releaseable attachment to front and rear boot bindings on a ski, the ski boot comprising:

a toe portion having a toe sole and a relatively rigid upper toe shell, said toe sole in said upper toe shell configured to extend around and enclose a forward part of the foot from a forward tip receiving the toes rearwardly to a location proximate the ball of the foot, said upper toe shell having a rear edge extending over the ball of the foot, said forward tip defining an exterior surface which is sized and configured to be capable of being received and engaged by a front binding mounted on a ski for releaseable binding engagement therewith;

a rear heel portion having a rear sole and a relatively rigid upper rear shell, said upper rear shell having an access opening to permit insertion and removal of the foot and extending around the ankle and back part of the foot forwardly to a location proximate the ball of the foot and having a forward edge extending over the ball of the foot, said rear sole underlying the foot and extending from a location proximate the ball of the foot rearwardly to a sole heel beneath the heel of the foot;

hinge means for interconnecting said toe portion and said rear heel portion in relative rotational motion about a rotational axis in a plane substantially parallel to the plane of the toe sole, said relative rotational motion taking place between a flat position wherein the respective planes of said toe and rear soles are substantially parallel and a flex position wherein the planes of said soles are at an angle with respect to one another, said forward edge and said rear edge defining a wedge-shaped cutout region between said toe and rear shells when said soles are in the flat position, said hinge means further interconnecting said toe portion and said rear heel portion in a manner substantially prohibiting relative torsional movement therebetween;

a heel bracket including a heel member located adjacent said sole heel when the boot is in the flat position, said heel bracket pivotally connected to said toe portion for pivotal movement with respect thereto independently of pivotal motion of said heel portion, said heel member sized and configured to be capable of being received and engaged by the rear binding mounted on the ski for releaseable binding engagement therewith;

said toe portion being secured by said front binding and said heel member being secured by said rear binding such that the plane of said toe sole is substantially parallel to the side of the ski upon which said front and rear bindings are mounted, said securing of the toe portion being such that said heel portion is capable of pivoting about said fixed rotational axis between said flat and flexed positions while said rear binding secures said heel member, said pivoting thereby facilitating skiing in the traditional nordic style.

2. A ski boot according to claim 1 including fastening means for releaseably fastening the heel bracket to the heel portion so that when fastened, said skier may both ski in the traditional alpine mode and walk without the skis, said skiing in the alpine mode being facilitated when the heel bracket and heel portion are fastened together such that the toe and heel portions are in the flat position and releaseably bound to the ski by the ski's front and rear bindings, said walking without skis being facilitated when the boot is released from the front and rear bindings and thereby removed from the skis and said heel bracket is fastened to said heel portion for common movement therewith so that said heel portion and heel bracket are capable of pivoting together as a unit with respect to said toe portion.

3. A ski boot according to claim 1 wherein said heel member includes a heel plate extending underneath said sole heel.

4. A ski boot according to claim 3 wherein said heel plate is configured as a grate.

5. A ski boot according to claim 3 including spacer means for maintaining said heel plate and said sole heel in relatively spaced apart relation in the flat position.

6. A ski boot according to claim 3 including snow expulsion means on one of said heel plate and sole heel for applying a lateral dislodging force on any snow located between said heel plate and said sole plate as the boot moves from the flex position to the flat position while attached to the ski.

7. A ski boot according to claim 6 wherein said snow expulsion means includes a longitudinal wedge on said one of said heel plate and sole heel.

8. A ski boot according to claim 6 wherein said snow expulsion means includes a transverse wedge on said one of said heel plate and sole heel.

9. A ski boot according to claim 6 wherein said snow expulsion means includes a star shaped wedge structure on said one of said heel plate and sole heel.

10. A ski boot according to claim 1 wherein said heel member includes a U-shaped strap structure extending from either side of said sole heel around the rear of the heel portion whereby said sole heel is received within the strap structure when the boot is in the flat position.

11. A ski boot according to claim 1 including hyperextension limit stop means for limiting relative angular rotation of the toe and heel portions as they relatively rotate from the flexed position toward the flat position to prevent further rotation and to thereby prohibit hyperextension of the foot and unwanted withdrawal of the forward tip of the toe portion from the front binding.

12. A ski boot according to claim 11 wherein said hyperextension limit stop means is selectively adjustable to vary the relative angular orientation of said toe and heel portions at which rotational movement is prevented.

13. A ski boot according to claim 1 including hyperflexion limit stop means for limiting the maximum relative rotation angle from the flat position to the flex position.

14. A ski boot according to claim 13 wherein said hyperflexion limit stop means limits the relative rotation angle to a maximum of 65°.

15. A ski boot according to claim 13 wherein said hyperflexion limit stop means includes a cable interconnecting said heel portion and said heel bracket whereby forces tending to hyperflex the ski boot are transmitted to said heel member.

16. A ski boot according to claim 1 wherein said toe sole and said heel sole are formed of a unitary piece of flexible material.

17. A ski boot according to claim 1 wherein said hinge means provides a common hinge structure for said toe and heel portions and said heel bracket.

18. A ski boot according to claim 1 wherein said heel bracket includes a pair of bracket arms extending forwardly of said heel member alongside of said heel portion with there being one bracket arm on either side thereof, each said bracket arm having a front end pivotally connected to said toe portion whereby said heel member is pivotally secured thereto.

19. A ski boot according to claim 18 wherein said hinge means includes a trunnion pin structure both connecting said toe and heel portions for relative rotation and connecting said heel bracket to said toe 20. A ski boot according to claim 1 wherein said toe portion and said heel portion are constructed as independent units and including an upper flexible panel overlapping an upper perimeter portion of both the rear edge of said toe portion and the forward edge of said heel portion to protect the upper region therebetween from the ingress of snow and other unwanted material.

21. A ski boot according to claim 20 including a lower flexible panel overlapping a lower perimeter portion of both the rear edge of said toe portion and the forward edge of said heel portion to protect the lower region therebetween from the ingress of snow and other unwanted materials.

22. A ski boot according to claim 20 wherein said upper panel is provided with transverse pleats.

23. A ski boot according to claim 1 including an intermediate stop means which may be selectively accuated for preventing said heel portion from returning to the flat position from the flex position so that said sole heel is held at a position above said heel member.

24. A ski boot according to claim 1 wherein said hinge means includes an extension linkage whereby said toe portion is pivotally connected to a first end of said extension link and said heel portion is pivotally connected to a second end of said extension link.

25. A ski boot according to claim 24 wherein said extension linkage comprises a pair of single links, one on each side of said toe portion, each said link having a forward end pivotally connected to the toe portion and a rearward end pivotally connected to said heel portion.

26. A ski boot according to claim 24 wherein said extension linkage comprises a pair of chain-like linkage elements, one on each side of said toe portion, each said chain-like linkage element having a plurality of links and having a forward end pivotally connected to the toe portion and a rearward end pivotally connected to said heel portion.

27. A ski boot for receiving a skier's foot and ankle in a manner that minimizes torsional rotation of the foot, while permitting bending movement about the ball of the foot and adapted for releaseable attachment to front and rear boot bindings on a ski, the ski boot comprising:

a toe portion having a toe sole and a relatively rigid upper toe shell, said toe sole in said upper toe shell configured to extend around and enclose a forward part of the foot from a forward tip receiving the toes rearwardly to a location proximate the ball of the foot, said upper toe shell having a rear edge extending over the ball of the foot, said forward tip defining an exterior surface which is sized and configured to be capable of being received and engaged by a front binding mounted on a ski for releaseable binding engagement therewith;

a rear heel portion having a rear sole and a relatively rigid upper rear shell, said upper rear shell having an access opening to permit insertion and removal of the foot and extending around the ankle and back part of the foot forwardly to a location proximate the ball of the foot and having a forward edge extending over the ball of the foot, said rear sole underlying the foot and extending from a location proximate the ball of the foot rearwardly to a sole heel beneath the heel of the foot; said rear heel portion being pivotally connected to said toe portion so that a junction area is defined between said rear edge and said forward edge, said heel portion moveable between a flat position wherein the respective planes of said toe and rear soles are substantially parallel and a flex position wherein the planes of said soles are at an angle with respect to one another;

a heel bracket having a heel member and a pair of bracket arms each connected to said heel member and extending forwardly in spaced relation to one another to terminate in a respective forward end; and hinge means for securing the forward ends of said bracket arms to said toe portion such that said heel bracket is capable of pivoting with respect to said toe portion independently of said heel portion, so that the heel member may be oriented in an adjacent position with respect to said sole heel with said bracket arms positioned alongside said upper rear shell on either side thereof and so that the heel member may be pivoted away from the adjacent position.

28. A ski boot according to claim 27 wherein said toe sole and said heel sole are formed of a unitary piece of flexible material, said heel portion being pivotally connected to the toe portion by said unitary piece.

29. A ski boot according to claim 27 wherein said toe portion, said heel portion and said heel bracket being pivotally connected to one another by a common trunnion pin structure.

30. A ski boot according to claim 27 including a toe baffle piece secured to said toe portion and overlapping said junction area to prevent the ingress of snow into said ski boot.

31. A ski boot according to claim 30 wherein said upper rear shell is split along an upper longitudinal portion into facing side panel, and including an ankle baffle mounted to said upper rear shell in such manner to prevent the ingress oil snow into said ski boot.

32. A ski boot according to claim 31 wherein said toe baffle and said ankle baffle are provided with transverse pleats whereby they may flex therealong as the ski boot is moved between the flat and flexed positions.

33. A ski boot according to claim 27 wherein said toe sole and said heel sole are formed as independent pieces having a separation region therebetween, and including a masking panel extending across said separation region.

34. A ski boot according to claim 33 wherein said masking panel is formed of stretchable material.

35. A ski boot according to claim 33 wherein said masking panel is formed of flexible material and is slideably mounted with respect to at least one of said toe and heel soles.

36. A ski boot according to claim 27 wherein said heel member includes a heel plate adapted to be positioned in closely spaced parallel relation to said sole heel.

37. A ski boot according to claim 36 wherein said heel plate is formed as a grate.

38. A ski boot according to claim 36 wherein one of said heel plate and said sole heel is provided with a wedge structure operative to attack and dislodge any snow build-up therebetween as said bracket member pivots with respect to said heel portion.

39. A ski boot according to claim 27 wherein said heel member is defined by a U-shaped rigid strap that extends from one bracket arm to the other bracket arm in a plane parallel thereto to form a region adapted to receive the sole heel with said strap extending around the rear of the ski boot.

40. A ski boot according to claim 27 including a hyperflexion limit stop to prevent said heel portion from pivoting beyond the desired flex position as it moves from the flat position to the flex position.

41. A ski boot according to claim 40 wherein said hyperflexion limit stop includes a cable interconnecting said heel portion and said heel bracket whereby forces tending to hyperflex the ski boot are transmitted to said heel member.

42. A ski boot according to claim 27 including a hyperextension limit stop to prevent said heel portion from pivoting beyond a selected position corresponding to the flat position as it moves from the flex position to said flat position.

43. A ski boot according to claim 42 including adjustment means associated with said hyperextension limit stop to permit selective adjustment thereof at selected positions on either side of said flat position.

* * * * *